United States Patent [19]

Citterio

[11] 4,371,221

[45] Feb. 1, 1983

[54] COMPOSITE MODULAR ELEMENT STRUCTURE FOR FURNISHINGS

[76] Inventor: Camillo Citterio, Via Don Minzoni, 6 Robbiano di Giussano, Province of Milan, Italy

[21] Appl. No.: 55,927

[22] Filed: Jul. 6, 1979

[30] Foreign Application Priority Data

Feb. 2, 1979 [IT] Italy ..... 20680/79[U]

[51] Int. Cl.³ ..... A47B 53/00; A47B 87/00

[52] U.S. Cl. ..... 312/199; 312/111; 312/257 R; 312/264

[58] Field of Search ..... 312/111, 198, 199, 257 R, 312/264, 265

[56] References Cited

U.S. PATENT DOCUMENTS

| | | | |
|---|---|---|---|
| 2,987,356 | 5/1961 | Simpson, Jr. | 312/257 R |
| 3,029,119 | 4/1962 | Spadolini | 312/264 |
| 3,360,320 | 12/1967 | Lust | 312/265 |
| 3,879,096 | 4/1975 | Blodee | 312/265 |
| 4,154,493 | 5/1979 | Prater | 312/264 |

*Primary Examiner*—Victor N. Sakran

*Attorney, Agent, or Firm*—Guido Modiano; Albert Josif

[57] ABSTRACT

A composite modular element structure for furnishings comprises side elements, back elements located in guides at the vertical edges of the side elements, roof and base panels adapted for assembling to the side elements and tie members for assembling the side elements and roof and base panels together.

8 Claims, 16 Drawing Figures

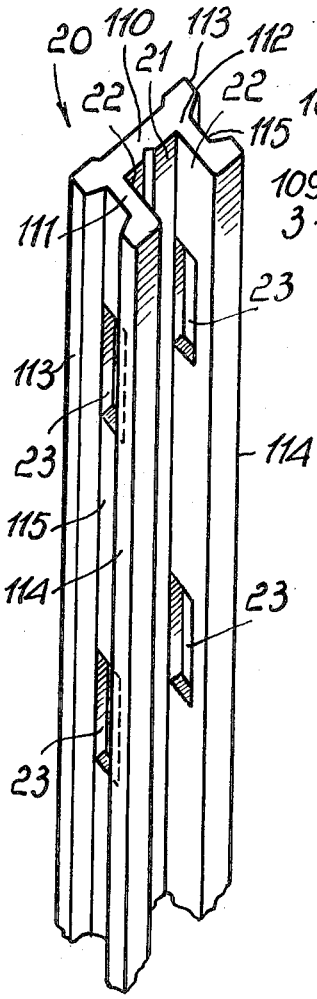
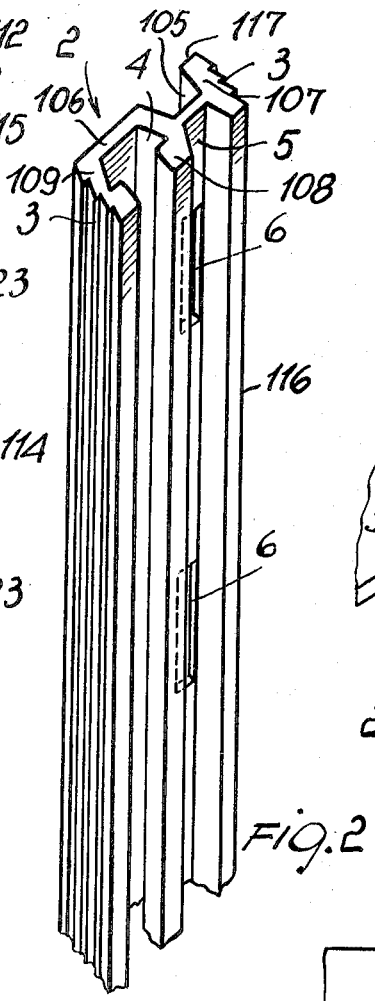
Fig.2
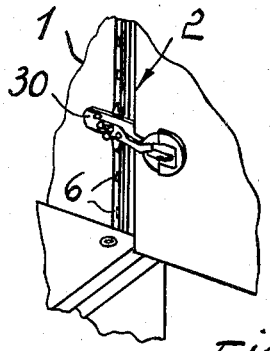
Fig.4
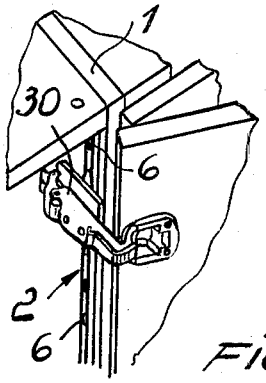
Fig.5
Fig.3
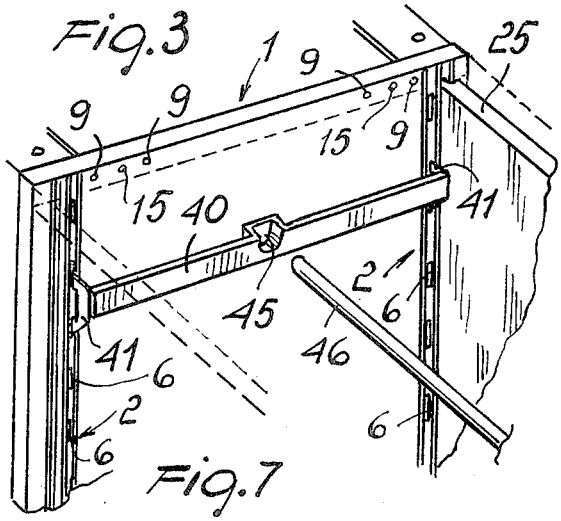
Fig.7
Fig.6
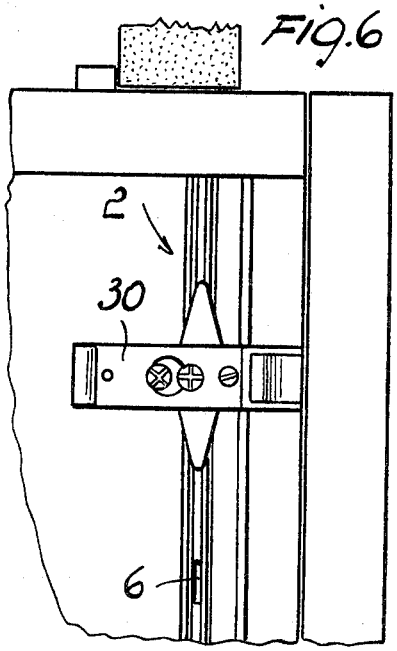

COMPOSITE MODULAR ELEMENT STRUCTURE FOR FURNISHINGS

BACKGROUND OF THE INVENTION

This invention relates to a composite modular element structure for furnishings, in particular one which provides so-called "equipped walls."

Several types of composite modular elements for furnishings are currently available in a large variety of shapes and designs which, however, have the disadvantage that their degree of modularization is rather limited, that is, composite elements of conventional design fall short of providing furnishings layouts which can be rapidly adjusted to suit individual user's requirements, so that it is frequently necessary to arrange for the provision of parts or items expressly made to fit a specific layout, which obviously results in a cost increase.

Another drawback of conventional composite elements is that they do not provide for easily and quickly carried out modifications of the latout as installed, because no possibility for changing or replacing existing elements is afforded thereby.

SUMMARY OF THE INVENTION

This invention sets out to eliminate the drawbacks encountered heretofore by providing a composite modular element structure for furnishings, which is so conceived as to be highly versatile, or flexible in application, such as to readily adapt itself to any layout or combination of elements which the user may require.

Within that general aim, it is an object of this invention to provide composite modular elements which make up in practice a furnishing system capable of rationally meeting any of today's living and working space requirements.

The composite modular elements of this invention both permit the erection of an equipped, or pre-furnished, wall to divide a space in accordance with a modular layout providing an infinite number of combinations, and of a built-in wardrobe, or of a jutting or partition type of wardrobe, either closed by means of wing doors or swing-down doors, and/or equipped with drawers, table tops, beds, or any other desired furniture arrangement.

Moreover, its adaptability, as afforded by special provisions, also permits more specific space furnishings problems to be solved, such as creating a corner piece, arranging for utilities or a passage, as well as erecting large size or small size lockers or closets.

These composite modular elements are dimensioned modularly in width, as well as in height and depth, thereby they are extremely flexible and suitable for mass production techniques, with obvious attendant benefits of an economical nature.

Furthermore, the composite modular elements of this invention ensure that the highest degree of layout change and extension ability is attained, even after a a prolonged time period.

These and other objects, such as will become apparent hereinafter, are all achieved by a composite modular element structure for furnishings, according to this invention, characterized in that it comprises side elements having, in the proximity of the vertical edges thereof, guide means for the attachment of backrests or back elements and/or accessories, said side elements being adapted for assembling to the roof and base panels of said structure by means of tie members carried on said side elements.

BRIEF DESCRIPTION OF THE DRAWING

Further features and advantages will become more clearly apparent from the following detailed description of a composite modular element structure for furnishings, illustrated by way of example and not of limitation in the accompanying drawings, where:

FIG. 2 is a perspective view of the guide means;

FIG. 3 is a perspective view of the middle or intermediate guide means;

FIG. 4 is a perspective view of a hinge for a glass pane type of wing door;

FIG. 5 is a perspective view of a wing door hinge;

FIG. 6 is an elevational view of a wing door hinge;

FIG. 7 is a perspective view of a coat hanging crossbar;

DESCRIPTION OF THE PREFERRED EMBODIMENT

Figure 1:
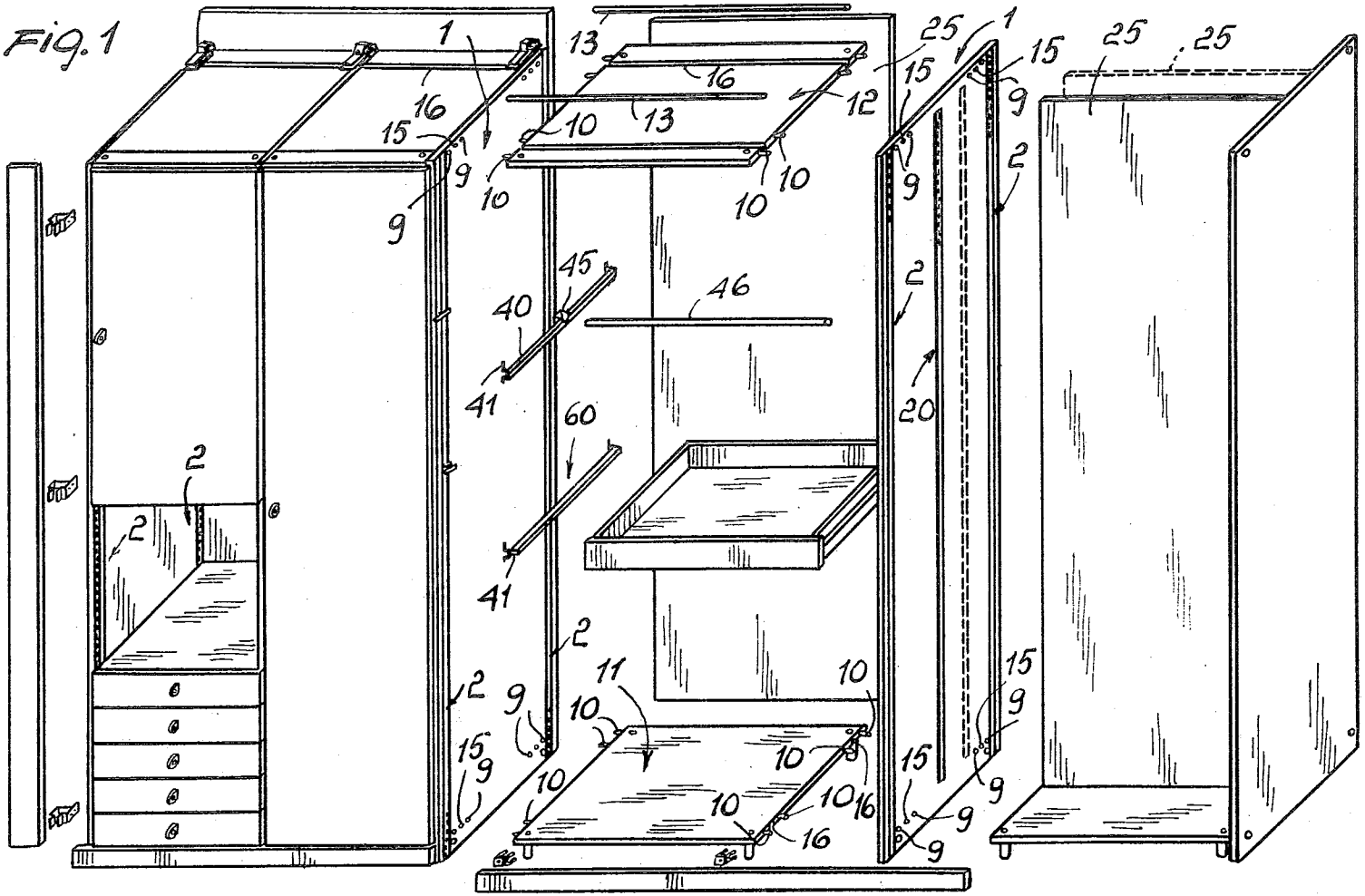
FIG. 1 shows schematically an exploded view of one possible combination of the composite modular elements.

With reference to the cited drawing figures, the composite modular element structure for furnishings characteristically comprises side elements, generally indicated at 1, which are preferably made from a two-ply panel or sheet cut to various height and width dimensions such as to afford a most flexible utilization of the modular system.

A characteristic feature of the invention is that each side element has on both its main faces guide means located close to the vertical edges thereof.

Such guide means (FIG. 2) comprise a sectional member, generally indicated at 2, having racks along its side edges which permit the sectional member 2 to be set in flush with the panel faces.

The sectional member 2, constituting said guide means, has a vertical channel 4 alongside which there extends a longitudinal seat 5 formed with notches 6 at regular intervals apart which form in practice a rack member.

Such guide means, as comprising the sectional member 2, are of considerable import to the invention, inasmuch as, in actual practice, they both provide for the connection of the backrest or back element of a wardrobe or closet being erected and of the wing door hinges, as well as of a wide range of optional accessory items.

The side elements are formed, both at the top and bottom thereof, with locating holes, indicated at 9, wherethrough locating pegs 10 can be inserted which are respectively provided on the base panel 11 and roof panel 12. The side elements are assembled, to produce a desired item of furniture, by means of tie members 13 which extend substantially perpendicularly to the planes defined by the side elements 1 and are carried by the side elements themselves; in practice, the tie members, which are accommodated in through holes 15 provided in the side elements 1 and in notches 16 provided respectively in the roof panel 12 and base or bottom panel 11, have the function of stiffening and holding firmly together the side elements, thus producing a carrying structure for the furniture items aimed at.

Furthermore, and since it will be possible to utilize the composite modular elements of the invention to produce wardrobes or the like accessible constructions, there are provided, as required and on one side or the other, or on both sides, middle or intermediate guide means in the form of a sectional member 20 for application to a middle or intermediate portion of the side elements and having a central seat 21 bordered by edges 22 wherein recessed cutouts 23 are provided which, similarly to the notches 6 described above, practically form a rack member, the one difference being that in actual practice the cited recessed cutouts lay on mutually perpendicular planes.

In producing a wardrobe structure, the backrest or back element 25, in the particular instance of a single wing wardrobe, is inserted and received in the central channel 3, whereas in the instance of a wardrobe with wing doors on both faces, the backrest or back element is received in the central seal 21 of the sectional member 20.

To the carrying structure just described, a wide range of accessories may be attached which share the feature of being easy and quick to attach directly to the guide means comprising the cited sectional members 2 or 20. Thus, for example, and as shown in FIGS. 4 and 5, the hinges have a base 30 which is provided with projections adapted for insertion into and firm engagement with the notches 6, thereby the necessity for drilling holes or performing complex additional work in order to mount and accurately register the hinges is eliminated. FIG. 4 shows a wing door made from a glass pane or any other similarly transparent material, whereas FIG. 5 shows a door which may be defined as "traditional," and can be swung open through 180°.

Again by utilizing the cited guide means, as shown in FIG. 7, it is possible to mount to the inside of the carrying structure formed by the side elements and back element a coat hanger. For this purpose, a coat hanging crossbar 40 is provided which has lugs 41 at its ends for insertion in the notches 2 for supporting the crossbar 40. The crossbar 40 has a central recess 45 wherein the coat hanger 46 can be accommodated.

For shelving the wardrobe inside, bracket members are provided which comprise a base 50 wherefrom a hook 51 extends which can be inserted in the notches 2 or in the recessed cutouts 23 provided in the guide means for securing it in position; moreover, there extends from the base 50 a cantilever arm 52 which acts as a resting and supporting element for any shelf 53.

Figure 10:
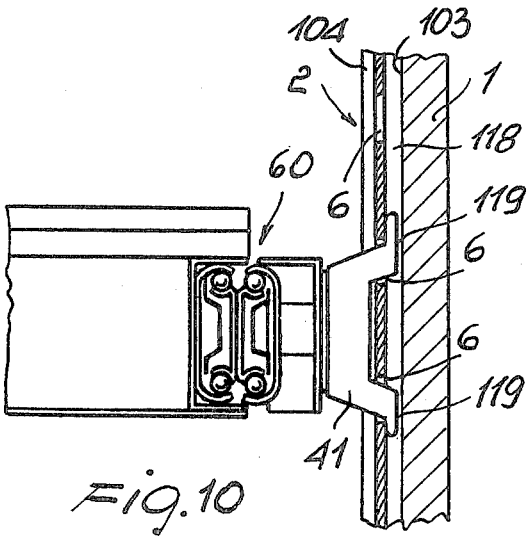
FIG. 10 is a front view of sliding guides.
Figure 11:
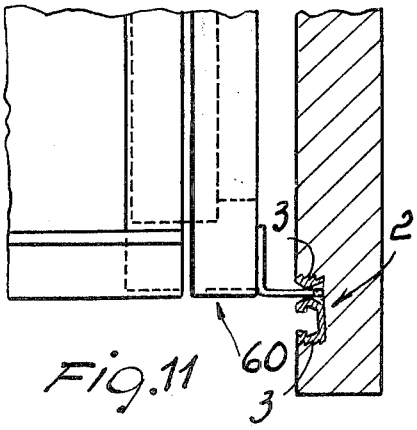
FIG. 11 is a plan view of the sliding guides.

With reference to FIGS. 10 and 11, there is illustrated schematically how sliding guides 60 may be attached, as for drawers or shelves, which are applied to the side elements by means of a crossbar provided with projections substantially similar in principle to the ones previously described with reference to the coat hanger application.

Figure 12:
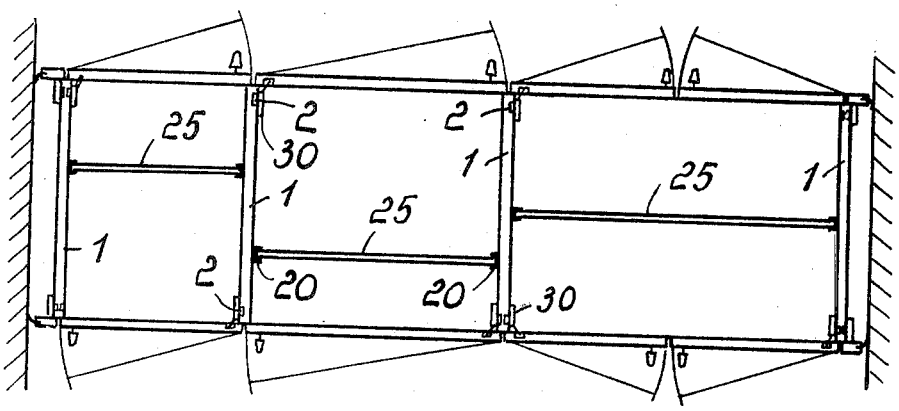
FIG. 12 is a top plan view of one possible furnishings layout.

Making now reference to FIG. 12, there is shown in plan view one possible combination of the modular elements wherein four side elements 1 are assembled to one another to provide a plural wing wardrobe, with the faculty of having doors provided on both faces thereof, in which case back elements or partitions 25 would be provided to divide the internal compartment of the wardrobe at any desired intermediate portion thereof.

Figure 13:
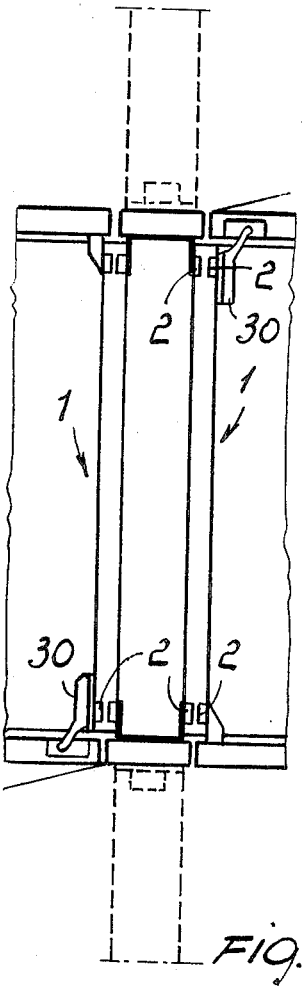
FIG. 13 shows schematically in plan view the connection to two side elements.
Figure 14:
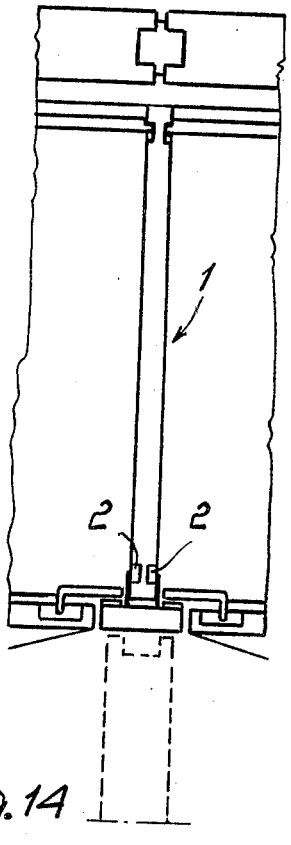
FIG. 14 shows schematically in plan view the connection to one side element.

As shown schematically in FIGS. 13 and 14, the modular elements of this invention provide actually an interior prefabrication system proper, since the modular elements afford the possibility of producing corridors, partition walls and equipped walls, and are easily interchangeable whenever one wishes to change their combination or layout. Thus, for example, FIG. 13 illustrates a combination wherein two side elements 1 are arranged beside each other, which combination is advisable when it is anticipated that one element may have to be changed at a later time; thus, it will be possible to remove the element to be changed without disassembling or disturbing the rest of the structure. When a permanent structure is aimed at, or one intended to last for a long time, the combination shown in FIG. 4 may be more convenient to adopt, wherein a single side element is provided.

Another significant feature, shown in FIGS. 13 and 14, is that it is possible to connect partition or equipped walls emerging perpendicularly from the rest of the structure, thus affording the possibility of dividing at will the available space or of merging agreeably with an existing masonry work.

Figure 16:
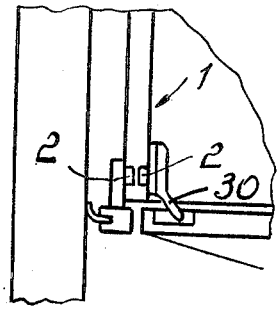
FIG. 16 is a schematical view of the connection of one wing door.
Figure 15:
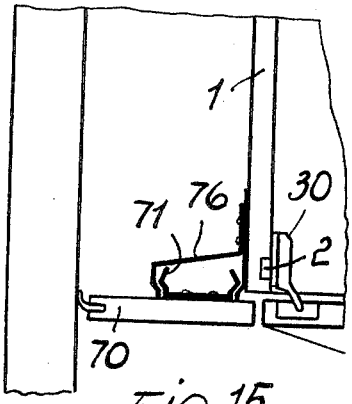
FIG. 15 is a plan view of a side fitting strip.

In FIGS. 16 and 17, the side fitting elements are schematically illustrated; these comprise strips effective to cover any gaps between the item of furniture produced with the modular elements described above and a fixed structure, constituted for instance by a wall. These strips, which are indicated at 70, have on their inside face an engagement member 71 which can be snap inserted into an elastic yoke 76 carried by one of the guide means, thus affording the possibility of readily assembling such elements, to complete and finish the erected structure, in a most simple and quick manner.

Similar elements, as shown schematically in FIG. 1, are used to produce a base molding for snap engagement with the feet of the base panel 11, and a top fitting strip to compensate for different ceiling heights, thus providing a finished front face for the furniture item erected.

From the foregoing description and from the drawings the following additional details should be noted.

Figure 8:
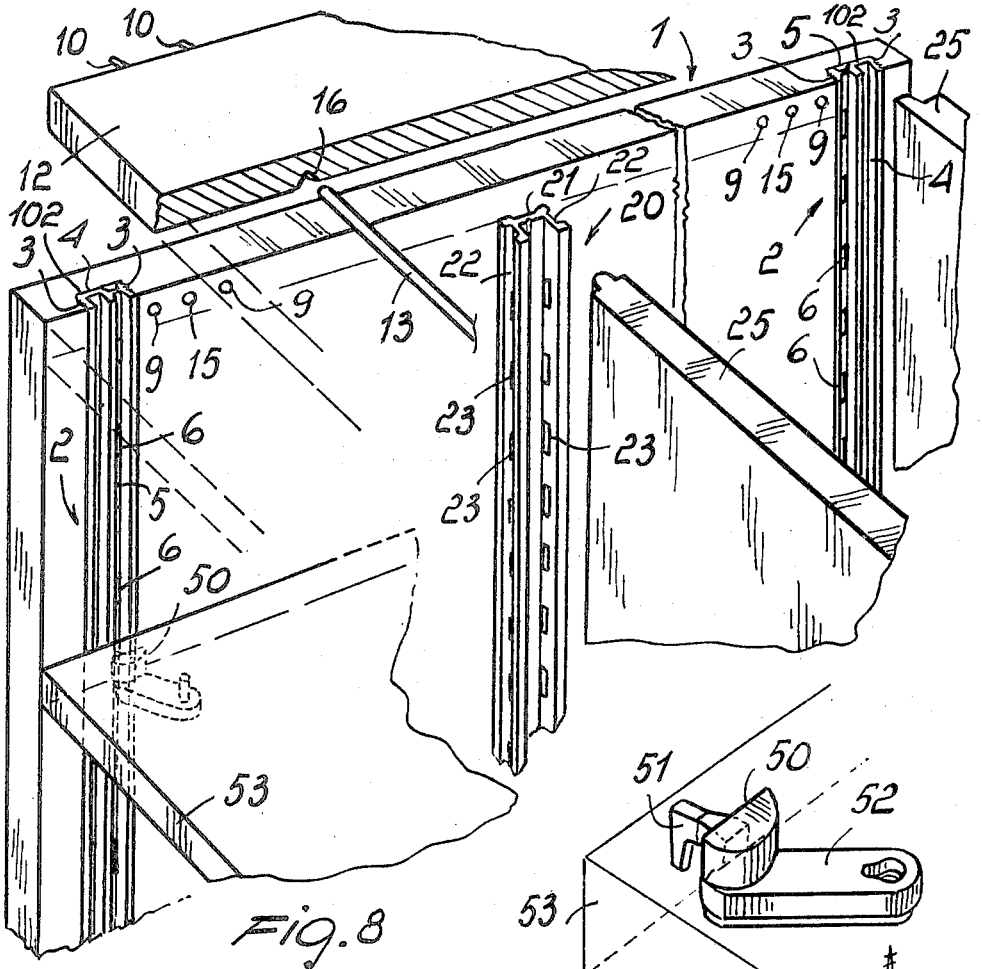
FIG. 8 is an exploded view of the connection of a backrest or back element to the side elements.
Figure 9:
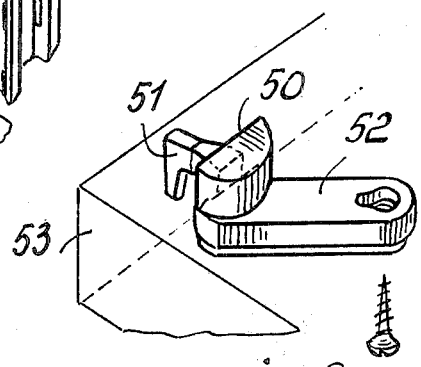
FIG. 9 is a persective view of a shelf supporting bracket.

The longitudinal vertical grooves, in which the sectional members 2 are inserted are indicated with reference numeral 102 (FIG. 8). These grooves 102 have a groove bottom 103 and groove flanks 104 (FIG. 10). It will be further noted that each sectional member 2 comprises a first web formation 105 and a second web formation 106, as well as flange formations 107, 108 and 109. The sectional members 20 comprise instead each a web formation 110 and flange formations 111 and 112 (FIGS. 2 and 3). It will be appreciated that the web formation 105 and the flange formations 111 and 112 provided with through slots 6 and cutouts 23, respectively, constitute engaging and supporting portions thereof for anchoring lug formations of accessory elements inserted therein. It will be further appreciated that the supporting portion of the web formation 105 extends along the groove 102 and faces the groove bottom 103, while the engaging portions of the flange formations 107 and 109 face and engage the groove flanks 104 and extend transverse to the web formations 105 and 106. The flange formations 107 and 109 have rib formations or racks or teeth 3, while the flange formations 111 and 112 have two laterally spaced rib formations 113 and 114 between which the engaging portions 115 of the flange formations are arranged in an offset or recessed position with respect to the rib formations 113 and 114. It will be further noted that the web formations 105, which constitute a supporting portion of the sectional member are inwardly offset with respect to the lateral edges 116 and 117 of the flange formations 107 so that said supporting or web portion 105 of the sectional member 2 is arranged at a distance from the groove bottom 103 to provide an anchoring interspace 118 (FIG. 10), when the sectional member 2 is inserted into the longitudinal groove 102. It will be further appreciated that a series of through slots 6 are arranged at regular intervals over the longitudinal extension of the supporting or web portion 105 of the sectional member 2. It will be further noted that the accessory elements have lug formations 41 partially insertable into the through slots 6 or cutouts 23 and such lug formations 41 have end portions 119 (FIG. 10) which extend into the anchoring interspace 118 and engage the rearward or opposite surface of the web formation 105 or engaging portion 115 of the flange formations 111 and 112.

The range of combinations that can be achieved is virtually infinite, and to the inside of the structure erected with the previously described side elements it will be possible to apply swing-down decks, table tops, beds, or any other possible solution.

The characterizing factor resides in fact in the side element design, which additionally to serving as a carrying structural member, also permits the back element to be simply assembled by jointing and provides means, in the form of the cited guide means, for securing any provided or planned range of accessories thereto.

In practicing the invention, the materials used, as well as the dimensions and shapes, may be any ones to suit individual applicational requirements.

I claim:

1. A composite modular element structure for furnishings, comprising a pair of spaced apart parallel vertical opposite side wall members, each including a pair of opposite vertical edge portions, each having a longitudinal groove extending parallel thereto and having a groove bottom and a pair of opposite groove flanks, a vertical back wall member connecting the opposite side wall members, vertical guideway-like means for the connection of said back and accessory elements and located in said longitudinal groove at each vertical edge portion of said side wall members, a roof panel and base panel adapted for assembling to said side wall members, tie members for assembling said side wall members and roof panel and base panel together, said tie members being carried by said side wall members and extending substantially perpendicular to said side wall members, wherein according to the improvement each sectional member comprises at least one web formation including supporting portions thereof and extending along said groove and facing said groove bottom and at least two spaced flange formations including engaging portions thereof and having lateral longitudinal edges and extending along said groove and facing said groove flanks and arranged tranverse to said web formation connecting said flange formations, each flange formation having rib formations at the outside surface thereof for engagement with said flanks of said grooves, said web formations having at least one supporting portion inwardly offset with respect to said lateral edges of said flange formations thereby said supporting portion of said web formation being arranged at a distance from said groove bottom to provide an anchoring interspace thereon when the sectional member is inserted in said groove, a series of through slots in said supporting portion and arranged at regular intervals over the longitudinal extension of said supporting portion of said web formations, and wherein said accessory elements have anchoring lug formations partially insertable selectively into said through slots and including an end portion thereof, which in the inserted position of said lug formation extends selectively into said anchoring interspace.

2. A structure according to claim 1, wherein said web and flange formations of said sectional members define in addition therebetween a vertical channel, which accomodates the edges of said back elements.

3. A structure according to claim 1, wherein said accessory elements comprise door hinges.

4. A structure according to claim 1, wherein said accessory elements include coat hanging crossbars.

5. A structure according to claim 1, wherein said accessory elements include shelf members.

6. A structure according to claim 1, wherein the accessory elements are sliding guides for drawers.

7. A structure according to claim 1, wherein said sidewall members further comprise at least one additional guideway-like means fixed in an intermediate position of said sidewalls and at least one partition wall connected thereto, said additional guideway-like means comprising said sectional member having said rib formations extending longitudinally and laterally spaced with respect to each other and maintaining therebetween at least one engaging portion of said flange formations offset with respect to said rib formations thereby to provide a further anchoring interspace therebetween, said engaging portion of said flange formation having a series of spaced cutouts in said engaging portions thereof and arranged at regular intervals over the longitudinal extension of said engaging portion of said flange formation for receiving therein said anchoring lug formations of said accessory elements.

8. A structure according to claim 1, further comprising through holes formed at the ends of said side wall members and carrying said tie members, there being further provided mating recesses in said roof and base panels for accomodating said tie members.

* * * * *